US006990308B1

(12) United States Patent
McAlpine et al.

(10) Patent No.: US 6,990,308 B1
(45) Date of Patent: Jan. 24, 2006

(54) IMAGE FORMING DEVICE, PRINT CARTRIDGE AND DOCTOR BLADE ASSEMBLY THAT REDUCE VIBRATIONS AT DOCTORING MEDIA NIP

(75) Inventors: Robert Watson McAlpine, Lexington, KY (US); Donald Wayne Stafford, Georgetown, KY (US); Gregory Scott Tigges, Frankfort, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/011,707

(22) Filed: Dec. 14, 2004

(51) Int. Cl.
*G03G 15/08* (2006.01)

(52) U.S. Cl. ..... 399/284; 399/265; 399/252; 399/222

(58) Field of Classification Search ..... 399/284
See application file for complete search history.

(56) References Cited

U.S. PATENT DOCUMENTS 4,760,422 A * 7/1988 Seimiya et al. ..... 399/284
5,085,171 A * 2/1992 Aulick et al. ..... 399/284
5,233,390 A 8/1993 Fujimoto
5,623,718 A 4/1997 Bracken et al.
5,702,812 A 12/1997 Bracken et al.
5,708,943 A 1/1998 Applegate et al.
5,722,022 A 2/1998 Park
5,797,076 A 8/1998 Bracken et al.
5,853,868 A 12/1998 Bracken et al.
6,697,594 B1 2/2004 Murphy et al.
6,813,466 B1 * 11/2004 Kopecky ..... 399/351
6,871,035 B2 * 3/2005 Nakagawa ..... 399/281

* cited by examiner

*Primary Examiner*—David M. Gray
*Assistant Examiner*—Laura K. Roth
(74) *Attorney, Agent, or Firm*—Arthur I. Navarro, Esq.

(57) ABSTRACT

A doctor blade assembly (121) for an image forming device such as a laser printer (100) includes a bracket (622) to which foam (640) is attached providing improved tolerances in the nip formed between the assembly (121) and the doctoring media. The assembly (121) includes a lip (625) which extends under the foam (640) to help secure the foam (640) and reduce the amount of adhesive required to keep the foam (640) attached. The bracket (622) is stamped from a single piece of metal providing a doctor blade assembly (121) with high stiffness that is cost effective to manufacture.

18 Claims, 4 Drawing Sheets

IMAGE FORMING DEVICE, PRINT CARTRIDGE AND DOCTOR BLADE ASSEMBLY THAT REDUCE VIBRATIONS AT DOCTORING MEDIA NIP

TECHNICAL FIELD

The present invention relates generally to a means for eliminating vibrations that reduce print quality in an image forming device such as a copier, facsimile machine or laser printer. More specifically, the invention relates to a print cartridge having a doctor blade assembly that eliminates vibrations at the nip formed between the doctoring blade and a doctoring surface. Still more specifically, the invention relates to a bracket for use in a print cartridge having support and clamping surfaces for improving tolerances at the nip.

BACKGROUND

Image forming devices including copiers, laser printers, facsimile machines, and the like, include a drum having a rigid cylindrical surface that is coated along a defined length of its outer surface with a photoconductive material. The surface of the drum is charged to a uniform electrical potential and then selectively exposed to light in a pattern corresponding to an original image. Those areas of the photoconductive surface exposed to light are discharged thus forming a latent electrostatic image on the photoconductive surface. A developer material, such as toner, having an electrical charge such that the toner is attracted to the photoconductive surface is brought into contact with the photoconductive surface. The drum then rotates past an intermediate transfer medium where the toner is transferred onto the medium. A recording sheet, such as a blank sheet of paper, is then brought into contact with the intermediate transfer medium and the toner thereon is transferred to the recording sheet in the form of the latent electrostatic image. The recording sheet is then heated thereby permanently fusing the toner to it. In preparation for the next image forming cycle, the photoconductive surface is discharged and residual toner is removed.

Typically, the toner is stored in a toner reservoir adjacent to the drum. A doctor blade and developer roller is positioned between the toner reservoir and drum for controlling the amount of toner passed to the drum. A nip created between the doctor blade and the developer roller controls the amount of toner transferred to the drum. It is important that the doctor blade make uniform and consistent contact across the entire length of the developer roller. If the doctor blade has inconsistent pressure with the developer roller during the transfer, uneven toner amounts will be transferred to the drum resulting in inconsistent and unacceptable print quality. If too much toner is transferred to the drum, printing errors may occur such as blurred images, poor color, and toner particles deposited on the background areas. Conversely, if not enough toner is transferred to the drum, the images will be too light and difficult to see.

Thus, for toner to be developed in an electro-photographic process it must be doctored out in a thin uniform layer onto a developer roll. The uniformity with which it is doctored has a direct impact on the quality of the resulting print. A problem in maintaining consistent contact and pressure is the developer roller profile may be non-uniformity requiring that the doctor blade move inward and outward to track the surface of the developer roller. Additionally, it is vital that contact be maintained across the entire length of the doctor blade to ensure even print quality across the width of the image. It is advantageous for the member doing the doctoring to be able to conform to the surface of the developer roll to reduce the effect of the geometry variations in the roll and in the doctoring member itself. It has been established that this can be accomplished using a piece of polyester coated with a conductive urethane filled with silicon carbide, attached to a foam substrate, adhered to an extruded metal bar.

One issue resulting from the use of an extruded metal bar is that the foam is unconstrained along its length and will shift with the friction of the surface of the rotating developer roll. The doctoring media (abrasively coated polyester) also has a propensity to vibrate audibly due to the stick-slip action of running against the roll. This stick-slip activity is facilitated by the shifting of the unconstrained foam which causes the doctor blade to move back and forth resulting in small perturbations on the developer roller which translate into small velocity variations. This may show up on a printed page as a repeating pattern of light and dark lines that extend across the printed image.

At least one design is known to use a conductive caulk to provide the electrical bridge between the supporting metal bar and the electrically conductive doctoring media. The caulk requires additional assembly time and curing time and suffers from a potential failure mode if applied improperly or damaged during assembly in the cartridge. The tolerances on the geometric properties of the bar limit the accuracy with which the foam can be positioned. Extensive testing has shown that positioning of the doctoring nip closer to the leading edge of the doctoring surface will result in fewer print defects such as skid marks.

One proposed solution is to lessen the amount of force that the doctor blade exerts on the developer roller. However, the amount of force applied by the doctor blade controls the amount of toner transferred to the developer roller. If the force is decreased to prevent or decrease jitter, toner transfer may be adversely affected. Also, it has been determined that lesser biasing force may prevent the doctor blade from sticking and skipping along the developer roller, but may not prevent vibrations that result in jitter. Further, another cause of jitter may be the electrical force between the developer roller and the drum. Lessening the amount of biasing force does not substantially reduce or eliminate this cause of jitter.

BRIEF DESCRIPTION OF THE DRAWINGS

The present invention is illustrated by way of example and not limitation in the figures of the accompanying drawings in which like references indicate similar elements, and in which.

DETAILED DESCRIPTION

Figure 1:
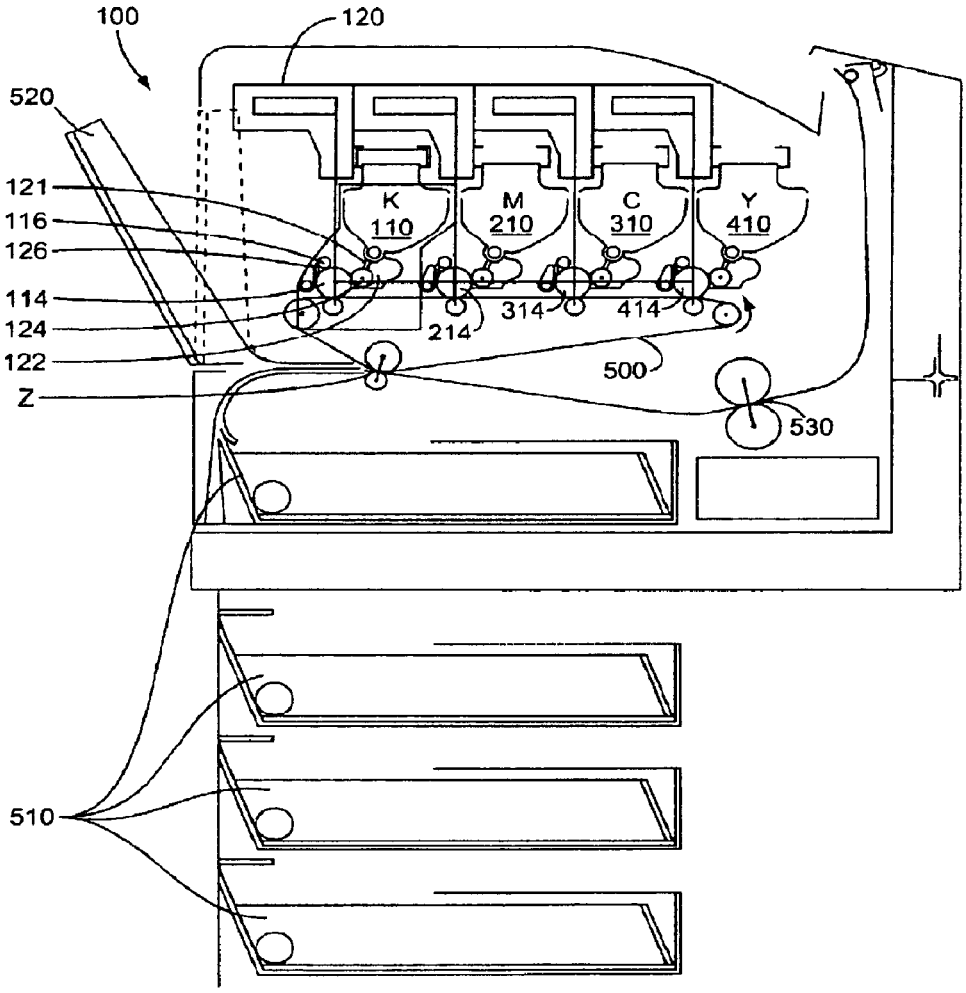
FIG. 1 is a side view illustrating an image forming apparatus constructed according to one embodiment of the present invention.

FIG. 1 illustrates the basic elements of an image forming device having a doctor blade assembly according to the present invention. Specifically, FIG. 1 is a diagram representative of a four cartridge color laser printer, denoted generally as 100, which illustrates the essential components of an electro-photographic apparatus. It should be understood, however, that those skilled in the art will understand that the present invention is applicable to other types of image forming systems using toner for printing with a photoconductor. The printer, image forming apparatus or image forming device, generally designated 100, includes a plurality of similar toner or print cartridges 110, 210, 310, and 410. Each print cartridge 110, 210, 310 and 410 is of a similar construction but is distinguished by the toner color contained therein. In the embodiment shown, the device 100 includes a black (K) cartridge 110, a magenta (M) cartridge 210, a cyan (C) cartridge 310, and a yellow (Y) cartridge 410. Each different color toner forms an individual image of a single color that is combined in layered fashion to create the final multi-colored image.

Each of the print cartridges 110, 210, 310 and 410 is substantially identical and includes a photoconductor, a development assembly, and a cleaning assembly. As the print cartridges 110, 210, 310 and 410 are identical except for the toner color, the print cartridge 110 and elements for forming black images will be described, with the other color image forming units being omitted for simplification.

A photosensitive drum 114 is generally cylindrically-shaped with at least one end that intermeshes with the image forming device drive gears to provide for a rotational force. The photosensitive drum 114 has a smooth surface for receiving an electrostatic charge over the surface as the photosensitive drum 114 rotates past charging device 116. The photosensitive drum 114 uniformly rotates past a scanning laser 120 directed onto a selective portion of the photosensitive drum 114 surface forming an electrostatically latent image across the width of the photoconductor representative of the outputted image. The drive gears rotate the photosensitive drum 114 continuously so as to advance the photosensitive drum 114 a predefined distance between laser scans. This process continues as the entire image pattern is formed on the photoconductor surface.

After receiving the latent image, the photosensitive drum 114 rotates to a developer which has a toner bin, illustrated generally as 122 in FIG. 1, for housing the toner and a developer roller 124 for uniformly transferring toner to the 114 photoconductor. The toner is transferred from the toner bin 122 to the photosensitive drum 114 through a doctor blade nip formed between the developer roller 124 and a doctor blade assembly 121. The toner is a fine powder usually constructed of plastic granules that are attracted and cling to the areas of the photosensitive drum 114 that have been discharged by the scanning laser 120.

The photosensitive drum 114 next rotates past an adjacently-positioned intermediate transfer mechanism belt 500 (hereinafter, ITM belt) to which the toner is transferred from the photosensitive drum 114. As illustrated in FIG. 1, the ITM belt 500 is endless and extends around a series of rollers adjacent to photoconductors 114, 214, 314 and 414. The ITM belt 500 and each photosensitive drum 114, 214, 314, 414 are synchronized providing for the toner from each photosensitive drum 114, 214, 314 and 414 to precisely align on the ITM belt 500 during a single pass. By way of example as viewed in FIG. 1, the yellow toner will be placed on the ITM belt 500, followed by cyan, magenta, and black.

After depositing the toner on the ITM belt 500, the photosensitive drum 114 rotates through a cleaning area where residual toner is removed from the surface via a brush or scraper 126. The residual toner is moved along the length of the photosensitive drum 114 to a waste toner reservoir. In one embodiment, the photosensitive drum 114 further passes through a discharge area (not shown) having a lamp or other light source for exposing the entire photoconductor surface to light to remove any residual charge and image pattern formed by the scanning laser 120.

As the photoconductors 114, 214, 314 and 414 are being charged and gathering toner, a recording sheet, such as a blank sheet of paper, is being routed to intercept the ITM belt 500. The paper may be placed in one of the trays 510, or introduced into the image forming device through a side track tray 520. A series of rollers and belts transport the paper to point Z where the sheet contacts the ITM belt 500 and receives the toner. The sheet may receive an electrostatic charge prior to contact with the ITM belt 500 to assist in attracting the toner from the ITM belt 500. The sheet and attached toner next travel through a fusser 530 having a pair of rollers and a heating element that heats and fuses the toner to the sheet. The paper with fused image is then transported out of the printer 100 for receipt by a user.

Figure 2:
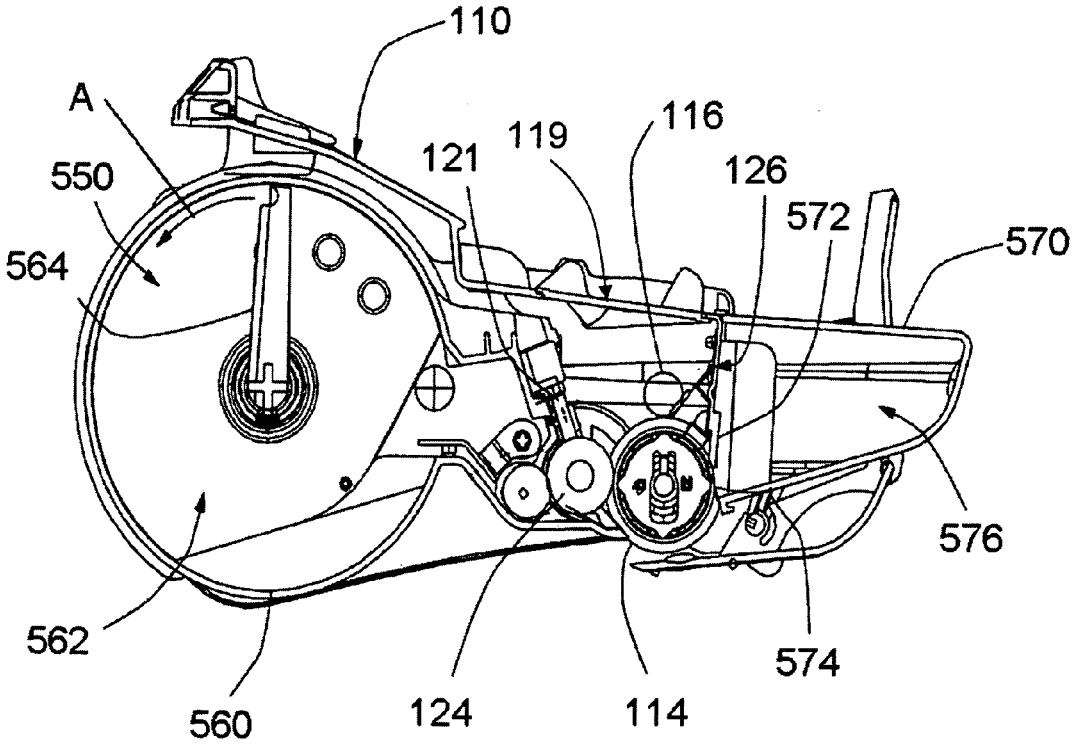
FIG. 2 is a side view of a print cartridge including the developer assembly and cleaning assembly along with the doctor blade assembly according to one embodiment of the present invention.

FIG. 2 is a detailed diagram of print cartridge 110 which, as described, above is essentially the same as any one of print cartridges 210, 310 and 410 of FIG. 1. In general, print cartridge 110 constitutes the image-forming section of an image forming device, such as laser printer 100. The photosensitive drum 114 rotates and receives a uniform charge by charging device 116 which exposes a light image onto the photosensitive drum 114 via an exposure section 119 to form a latent image on the photosensitive drum 114. A toner image corresponding to the latent image is formed by developer drum 550, thus making the image visible. After the toner image is transferred to the recording medium, toner remaining on the photosensitive drum 114 is removed by scraper 126 or other suitable cleaning means. These elements, including the photosensitive drum 114, are housed inside a development assembly 560 and cleaning assembly 570 which together constitute a housing that form the enclosure of the print cartridge 110. Each part of the print cartridge 110 is provided with a sealing member for preventing the toner from leaking.

As shown in FIG. 2, the development assembly 560 includes a toner well 562 for housing toner, and a rotary paddle toner feeding member 564. The toner feeding member 564 is provided within the toner well 562 and rotates as indicated in the direction of arrow A to circulate toner within the toner well 562. The developer roller 124 receives a thin toner layer on its surface (referred to as "doctoring surface") as a result of its rotation and is pressed against the photosensitive drum 114. The doctor blade assembly 121 is disposed adjacent the developer roller 124 to regulate the thickness of the toner layer formed on the doctoring surface. The electric charge is imparted to the toner by a biasing voltage on the doctor blade assembly 121. An important aspect of the present invention is the specific configuration of the doctor blade assembly 121 which, as described more fully below, substantially eliminates vibrations that would otherwise reduce print quality by improving tolerances at the nip formed between doctoring blade assembly 121 and a doctoring surface.

Cleaning assembly 570 comprises a cleaning blade 572 positioned in contact with the surface of the photosensitive drum 114 for scraping off the toner remaining on the photosensitive drum 114, a skimming seal 574, positioned below the cleaning blade 572 arranged in weak contact with the surface of the photosensitive drum 114, for retaining up the toner which has been scraped off, and a waste toner well 576 for storing the scraped-off waste toner.

Figure 3:
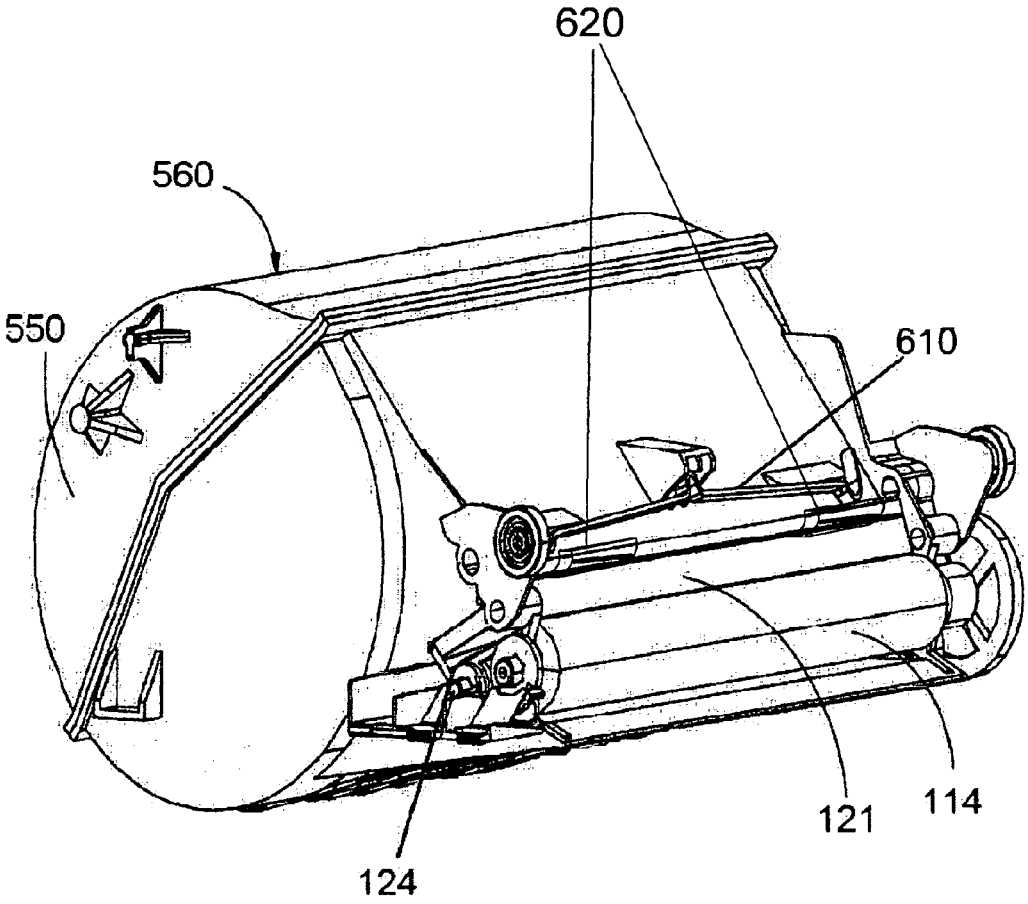
FIG. 3 is a perspective view of the developer assembly showing the doctor blade assembly according to one embodiment of the present invention.

FIG. 3 shows the development assembly 560 for a print cartridge, such as print cartridge 110, in more detail. Image development components of development assembly 560 include the doctor blade assembly 121, developer roller 124 and photosensitive drum 114. A key aspect of the present invention is the use of bracket-shaped doctor blade assembly 121 that substantially eliminates vibrations that occur during the operation and/or movement (such as during shipment) of print cartridge 110. Such vibrations are well known to reduce print quality. In general, doctor blade assembly 121 provides a support and clamping surface for improving tolerances at the nip formed between doctor blade assembly 121 and the doctoring surface (not shown) of the development roller 124.

Referring to FIG. 3, a doctor blade spring 610 is attached to the developer assembly 560 is positioned above the doctor blade assembly 121 to maintain a continuous force for biasing the doctor blade assembly 121 against the developer roller 124. The amount of force applied by the doctor blade spring 610 also controls the amount of toner transferred to the developer roller 124. The drawings illustrate the doctor blade assembly 121 substantially perpendicular to the developer roller 124, however, other orientations may also provide for transfer of proper toner amounts. The doctor blade spring 610 may contact the doctor blade assembly 121 at one or more locations along the length of the doctor blade assembly 121 to ensure an even and distributed force is applied across the entire width of the developer roller 124. In one embodiment, the doctor blade spring 610 provides about 1400 grams of force to the developer roller 124, although other configurations and variations are disclosed in U.S. Pat. No. 6,078,771, assigned to the Lexmark International, Inc., the assignee of the present application, which discloses various structures for an image forming apparatus and is incorporated by reference herein in its entirety.

Doctor blade assembly 121 includes upper lip members 620 which support doctor blade spring 610. Being integral to the main body of the doctor blade assembly, the use of upper lip members 620 eliminates the need for additional support structures for the doctor blade spring 610.

Figure 4:
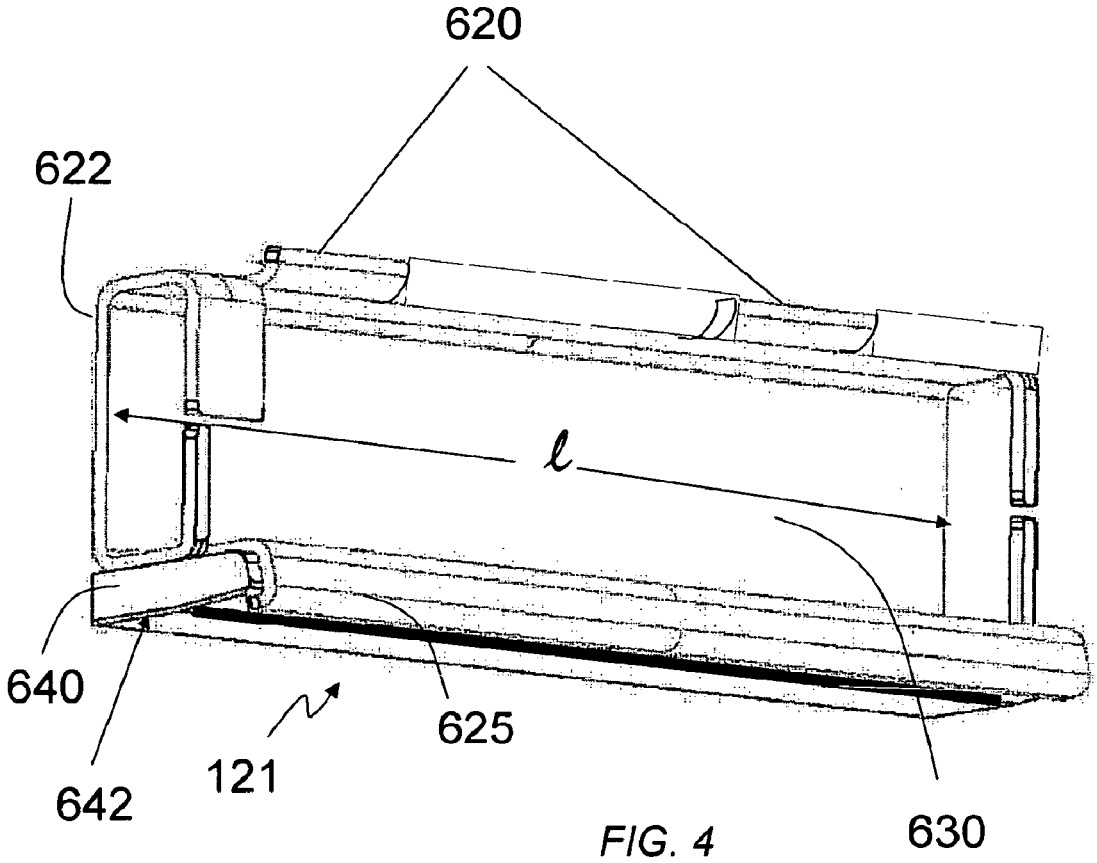
FIG. 4 is a detailed diagram of the doctor blade assembly in perspective view according to the present invention.

FIG. 4 shows the doctor blade assembly 121 according to the present invention in more detail. As shown, doctor blade assembly comprises a bracket 622 having length (L) to which at least one piece of foam 640 is attached. Preferably, bracket 622 is made from a single stamped metal piece to reduce the cost of manufacturing the doctor blade assembly 121 while providing sufficient stiffness and strength. The foam 640 is captured in both directions by the bracket 622 which serves to precisely locate the foam 640 as well as to keep it from shifting during running. The lip 625 under which the foam 640 is slipped helps retain the foam 640 thereby reducing the strength requirement and cost of the adhesive holding the foam to the bracket 622. The lip 625 also touches the actual doctoring media surface 642, which creates a conductive path between the metal bracket 622 and the doctoring media and eliminates the need for conductive caulk. The lip 625 also traps and dampens the media and stops the stick-slip vibration action and the resulting noise, which would otherwise occur when the cartridge 110 is running.

A recess 630 in the stamping along its length (L) also provides a pocket to install vibration dampening material (not shown) if necessary. The additional lip members 620 the top of the bracket 622 serves to retain the doctor blade spring 610. This eliminates the need for using retainers or any other similar fastening device. Because the doctor blade assembly 121 is made using a stamping process instead of an extrusion process, the straightness tolerances on the bracket 622 can be tighter without requiring special operations. The bent geometry of the stamped bracket 622 also has the advantage of creating a part with a very high stiffness. This helps reduce the flexing of the doctor blade assembly 121 during running and during shipping. Finally, because the process of stamping is highly automated and uses little material, the overall cost of the doctor blade assembly 121 is reduced.

It should be understood that modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A doctor blade assembly for an image forming device comprising a foam piece;

a bar having a length that extends substantially the length of a developer roller of a developer assembly within a print cartridge installed in said image forming device, the bar having a first lip-shaped structure for retaining said foam piece and a second lip-shaped structure for retaining a doctor blade spring of said print cartridge; and wherein a conductive path is created between said bar and said foam piece and wherein the stiffness of said bar is such that vibrations at an interface between said developer roller and said doctor blade assembly are substantially eliminated during operation of said image forming device.

2. The assembly of claim 1 wherein said bar comprises a single piece of metal.

3. The assembly of claim 2 wherein said bar is a stamped piece of metal.

4. The assembly of claim 1 wherein said bar further comprises a recess providing a pocket for installing vibration dampening material.

5. The assembly of claim 1 wherein said first lip-shaped structure is substantially perpendicular to said bar.

6. The assembly of claim 1 further comprising a piece of doctoring media attached to said foam.

7. A print cartridge for an image forming device comprising:

a development assembly including a doctor blade assembly, a developer roller and a photosensitive drum for forming images during an electro-photographic process;

a cleaning assembly coupled to said development assembly for removing toner from said photosensitive drum;

wherein said doctor blade assembly provides sufficient stiffness to substantially eliminate vibrations at an interface between said developer roller and said doctor blade assembly during operation of said image forming device, said doctor blade assembly further comprising:

a foam piece; and a bar having a length that extends substantially the length of said developer roller of said developer assembly within said print cartridge installed in said image forming device, the bar having a first lip-shaped structure for retaining said foam piece and a second lip-shaped structure for retaining a doctor blade spring of said development assembly.

8. The print cartridge of claim 7 wherein said bar comprises a single piece of metal.

9. The assembly of claim 7 wherein said bar comprises a stamped piece of metal.

10. The assembly of claim 7 wherein said bar further comprises a recess providing a pocket for installing vibration dampening material.

11. The assembly of claim 7 wherein said first lip-shaped structure is substantially perpendicular to said bar.

12. The assembly of claim 7 further comprising a piece of doctoring media attached to said foam piece.

13. An image forming device comprising at least one print cartridge including a development assembly and a cleaning assembly said development assembly including a photosensitive drum for receiving an electrostatic charge corresponding to a desired latent image, said development assembly further comprising a developer roller for transferring toner to said photosensitive drum and a doctor blade assembly for controlling the dispersion of toner on said developer roller, said doctor blade assembly providing sufficient stiffness to substantially eliminate vibrations at an interface between said developer roller and said doctor blade assembly during operation of said image forming device said doctor blade assembly further comprising:

a foam piece; and a bar having a length that extends substantially the length of said developer roller of said developer assembly within said print cartridge installed in said image forming device, the bar having a first lip-shaped structure for retaining said foam piece and a second lip-shaped structure for retaining a doctor blade spring of said development assembly.

14. The print cartridge of claim 13 wherein said bar comprises a single piece of metal.

15. The assembly of claim 13 wherein said bar comprises a stamped piece of metal.

16. The assembly of claim 13 wherein said bar further comprises a recess providing a pocket for installing vibration dampening material.

17. The assembly of claim 13 wherein said first lip-shaped structure is substantially perpendicular to said bar.

18. The assembly of claim 13 further comprising a piece of doctoring media attached to said foam piece.

* * * * *